US009771774B2

(12) United States Patent
Dighe et al.

(10) Patent No.: US 9,771,774 B2
(45) Date of Patent: Sep. 26, 2017

(54) ZONE ISOLATION CEMENTING SYSTEM AND METHOD

(71) Applicants: Shailesh Shashank Dighe, Katy, TX (US); Antonio Bottiglieri, Houston, TX (US)

(72) Inventors: Shailesh Shashank Dighe, Katy, TX (US); Antonio Bottiglieri, Houston, TX (US)

(73) Assignee: BAKER HUGHES INCORPORATED, Houston, TX (US)

( * ) Notice: Subject to any disclaimer, the term of this patent is extended or adjusted under 35 U.S.C. 154(b) by 34 days.

(21) Appl. No.: 14/922,864

(22) Filed: Oct. 26, 2015

(65) Prior Publication Data

US 2017/0114608 A1 Apr. 27, 2017

(51) Int. Cl.

| | |
|---|---|
| ***E21B 33/14*** | (2006.01) |
| ***E21B 34/14*** | (2006.01) |
| ***E21B 33/12*** | (2006.01) |
| *E21B 34/06* | (2006.01) |

(52) U.S. Cl.

CPC ..... *E21B 33/146* (2013.01); *E21B 33/12* (2013.01); *E21B 34/06* (2013.01)

(58) Field of Classification Search

CPC ..... E21B 34/14; E21B 33/12; E21B 21/103; E21B 33/14; E21B 43/10

See application file for complete search history.

(56) References Cited

U.S. PATENT DOCUMENTS 8,066,069 B2 * 11/2011 Giroux ..... E21B 4/02 166/177.4

OTHER PUBLICATIONS

"Cytadel ZY Electronically-Actuated Packer"; 2014 Baker Hughes Incorporated; bakerhughes.com; 8 pages.

* cited by examiner

*Primary Examiner* — Zakiya W Bates
(74) *Attorney, Agent, or Firm* — Cantor Colburn LLP

(57) ABSTRACT

A zone isolation cementing system includes a tubular having a longitudinal axis and a first flow-controlled port, a first conduit having a first end and a second end, the first end fluidically connected to the first flow-controlled port, a first distributor manifold arranged to deliver cement slurry exteriorly of the tubular, the second end of the first conduit fluidically connected to the first distributor manifold, and a first settable packer disposed exteriorly of the tubular and arranged longitudinally between the first flow-controlled port and the first distributor manifold.

20 Claims, 7 Drawing Sheets

ZONE ISOLATION CEMENTING SYSTEM AND METHOD

BACKGROUND

In the drilling and completion industry, the formation of boreholes for the purpose of production or injection of fluid is common. The boreholes are used for exploration or extraction of natural resources such as hydrocarbons, oil, gas, water, and alternatively for CO2 sequestration. Downhole production boreholes utilized in subterranean operations typically utilize casings disposed therein to protect the borehole from downhole pressures, chemical reactions and other conditions and prevent failures such as borehole collapse, burst, and tensile failures. Casings can also be used to define production zones in various portions of the borehole.

Cementing is a technique where cement slurry is used to secure various casing strings and/or liners in a well. Several factors may affect the performance of the cement in the borehole (or "wellbore"), including, but not limited to, length of the cement column in the borehole, formation pore pressure, formation fracture gradient and cement slurry density. It is often desirable to cement the casing into place by positioning cement into the annulus directly surrounding the casing by first pumping the cement down the casing and then into the annulus.

The art would be receptive to alternative devices and methods for cementing operations.

BRIEF DESCRIPTION

A zone isolation cementing system includes a tubular having a longitudinal axis and a first flow-controlled port, a first conduit having a first end and a second end, the first end fluidically connected to the first flow-controlled port, a first distributor manifold arranged to deliver cement slurry exteriorly of the tubular, the second end of the first conduit fluidically connected to the first distributor manifold, and a first settable packer disposed exteriorly of the tubular and arranged longitudinally between the first flow-controlled port and the first distributor manifold.

A method of isolating zones during a cementing operation includes delivering a first stage of cement slurry through a tubular and into a first zone of a borehole annulus; setting a first packer; and, moving a second stage of cement slurry through a first flow-controlled port in the tubular, through a first conduit, into a first distributor manifold, and delivering the second stage of cement slurry into a second zone, wherein the second zone is separated from the first zone by the first packer.

A method of isolating zones during a cementing operation includes disposing the zone isolation cementing system within a borehole; delivering a first stage of cement slurry through the tubular and into a first zone; setting the first packer; and, delivering a second stage of cement slurry out the first flow-controlled port in the tubular, through the first conduit, into the first distributor manifold, and into a second zone, wherein the second zone is separated from the first zone by the first annular packer.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Figure 1:
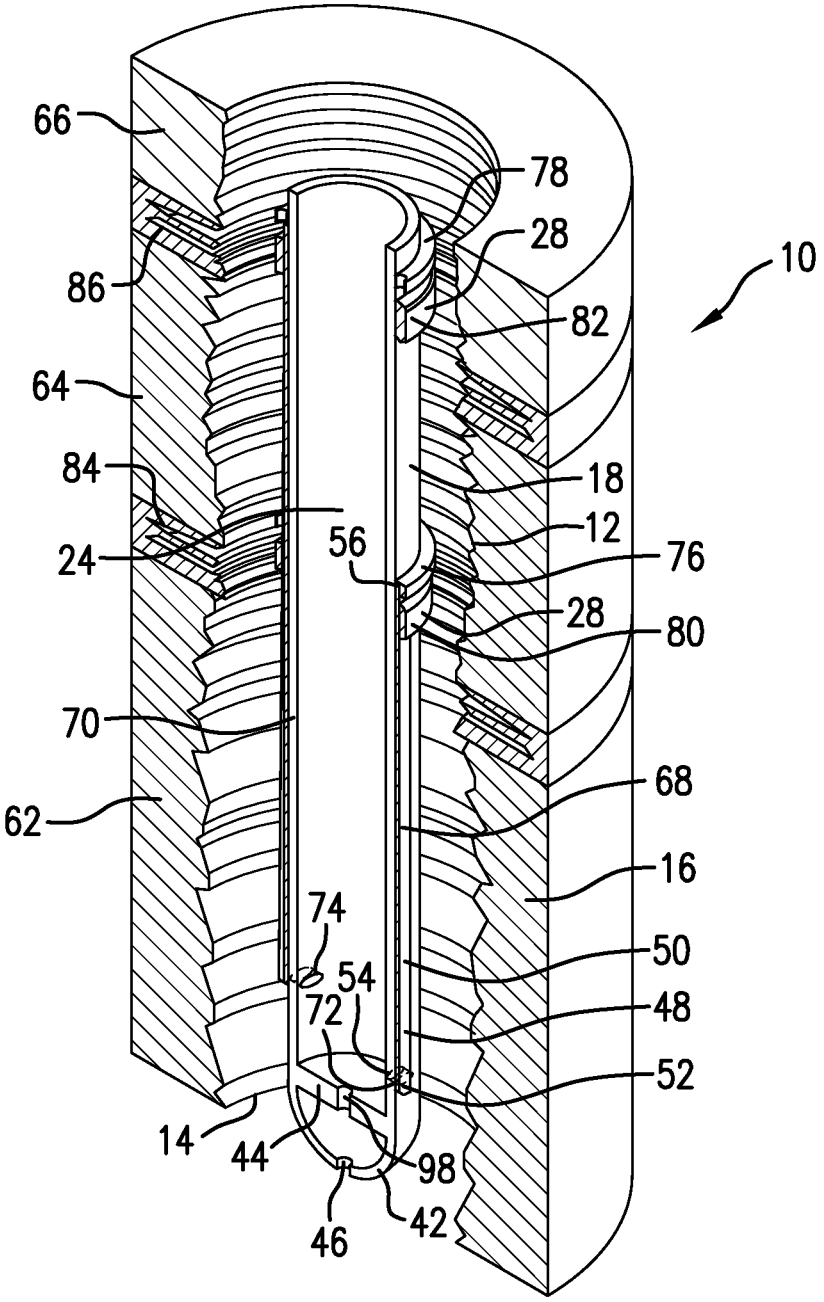
FIG. 1 depicts a perspective cut-away view of an embodiment of a zone isolation cementing system in a borehole prior to cementing.

Referring to FIG. 1, one embodiment of a zone isolation cementing system 10 is depicted in a borehole 14 prior to a cementing operation. The zone isolation cementing system 10 is shown to include a tubular 18 disposed in a borehole 14, the borehole 14 having a borehole wall 12. In the embodiment illustrated in FIG. 1, the tubular 18 is employed as a casing. The borehole 14 penetrates at least one earth formation 16 during a subterranean operation. As described herein, a "formation" refers to the various features and materials that may be encountered in a subsurface environment and surround the borehole 14. The borehole 14 may extend substantially vertically from a surface, or may additionally include portions that extend in directions deviating from vertical, including but not limited to portions that extend parallel or substantially parallel to the surface to form a horizontal well. The zone isolation cementing system 10 is not restricted to a particular well orientation. The tubular 18 when employed as a casing may be cemented or bonded to the borehole wall 12 via a casing support material 20 (FIGS. 3-7) such as, but not limited to, cement, that includes any suitable cementing or other material or combination of materials sufficient to bond the tubular 18 to the borehole wall 12, facilitate the tubular 18 in supporting and/or isolating portions of the borehole 14, or otherwise support the tubular 18. In one embodiment, the casing support material 20 is formed using a cement slurry 22 that is passed through the flowbore 24 of the tubular 18 and into the annulus 26 between the tubular 18 and the borehole wall 12.

The cement slurry 22 may include a material or mixture that is forced into the annulus 26 between the tubular 18 and the borehole wall 12 and serves to bond the tubular 18 to the borehole wall 12 to form a cement sheath surrounding the tubular 18. The casing support material 20 further includes at least one expandable packer 28 as an addition to the cement slurry 22. While the system 10 is useful in operations with a cemented tubular 18, the application of the tubular 18 is not limited to any particular casing support material 20 when the tubular 18 is employed as a casing.

The tubular 18 is made from any material suitable for withstanding downhole conditions such as pressure, temperature and chemical action. Non-limiting examples of such materials include steel, heat treated carbon steel, stainless steel, aluminum, titanium, fiberglass and other materials. In one embodiment, the tubular 18 includes a plurality tubular sections, such as pipe segments or casing joints, connected together via threaded ends or threaded joints or other connection mechanisms to achieve a sufficient length for the borehole 14, and the tubular 18 may extend any length of the borehole 14. For example, the borehole 14 may include a full tubular 18 extending from a surface or near surface location to a selected depth or a liner such as a production liner that is suspended in the borehole 14.

The formation 16 may include zones that are compromised by lack of formation strength, and therefore using a uniform cement sheath across the entire length of the annulus 26 between the tubular 18 and the borehole wall 12 may not adequately support the tubular 18 within the borehole 14. Thus, the zone isolation cementing system 10 separates adjacent zones from each other and also delivers cement separately to those zones. Determination of formation strength of particular zones may be made prior to utilization of the zone isolation cementing system 10, and features of the zone isolation cementing system 10 may be aligned within the borehole 14 so as to separate the zones from each other depending on the analysis of formation strength.

Figure 2:
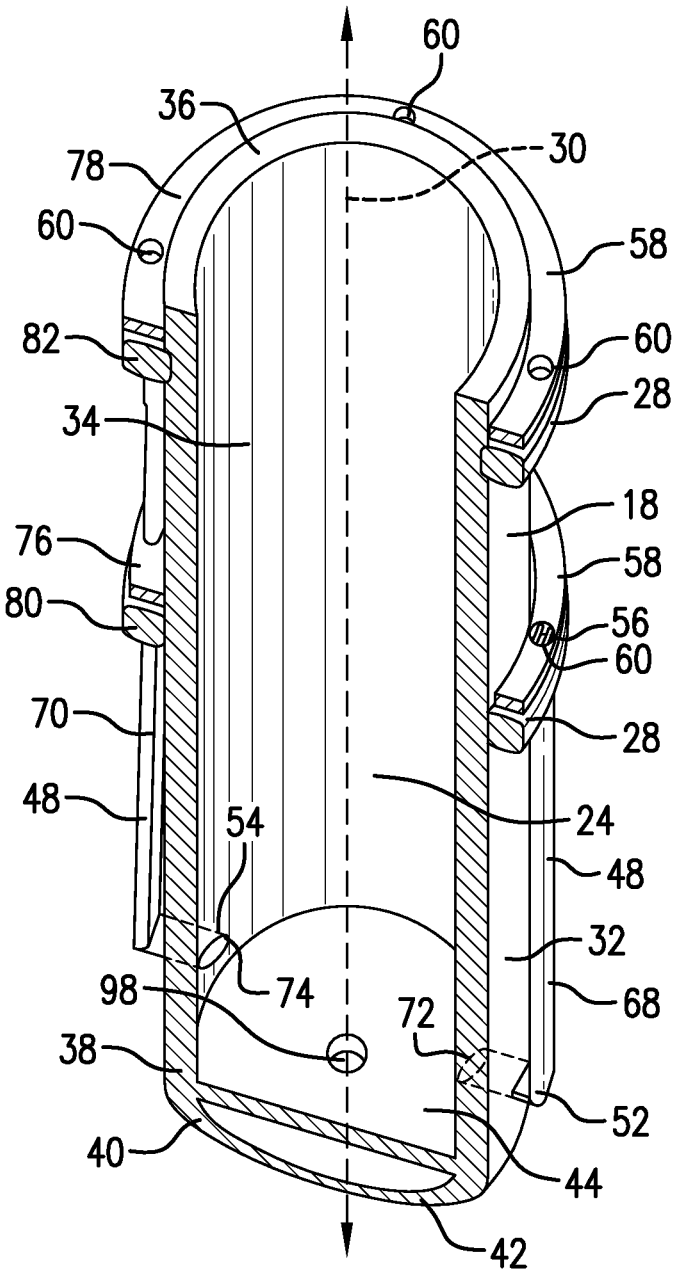
FIG. 2 depicts a perspective cut-away view of portions of the zone isolation cementing system.

With reference to FIG. 2, in order to separate zones from each other, the zone isolation cementing system 10, shown in part in FIG. 2, is disposed in the borehole 14 (FIG. 1). Although not illustrated, the tubular 18 may include a plurality of tubular sections to make up the full length of the tubular 18. The tubular 18 extends along a longitudinal axis 30 and includes an exterior surface 32, which faces the casing support material 20 and borehole wall 12 (FIG. 1), and an interior surface 34 defining the flowbore 24 or space for initially receiving the cement slurry 22 (FIG. 1) during the cementing operation, and subsequently receiving a production string or other downhole tools (not shown) after completion of the cementing operation. The tubular 18 includes an uphole portion 36 closer to a surface of the borehole 14, and a downhole portion 38 containing float equipment 40. The float equipment 40 may include a rounded profile float shoe 42 having an exit opening 46 that may include a check valve to prevent reverse flow of cement slurry 22 from the annulus 26 into the tubular 18, and a float collar 44 to receive thereon a cementing plug.

The zone isolation cementing system 10 further includes at least one secondary conduit 48. The secondary conduit 48 allows the cement slurry 22 to be placed within distinct zones during different stages of the cementing operation. That is, cementing can occur in stages rather than completing the entire length of the annulus 26 at once. Each secondary conduit 48 includes an interior passageway 50 (FIG. 1) that is separate from the flowbore 24. A longitudinal axis of the secondary conduit 48 is radially distanced from the longitudinal axis 30 of the tubular 18, and the flowbore 24 is not interrupted by the secondary conduit 48. In one embodiment, the secondary conduit 48 includes a first end 52, such as a downhole end, connected to a flow-controlled port 54 at the tubular 18 that is configured to fluidically connect the flowbore 24 within the tubular 18 to the interior passageway 50 of the secondary conduit 48. The flow-controlled port 54 is a radial port in the tubular 18. The flow-controlled port 54 to the secondary conduit 48 may be provided in a downhole-most joint of pipe of the tubular 18 just above (uphole of) the float collar 44. The flow-controlled port 54 may include any valve, such as, but not limited to, a remotely controllable valve, or may include a dissolvable material that dissolves when in contact with a material in the particular slurry 22 within the tubular 18. The flow-controlled port 54 blocks fluidic communication between the flowbore 24 and the passageway 50 in a closed condition of the port 54, and allows fluidic communication between the flowbore 24 and the passageway in an open condition of the port 54. While only one flow controlled port 54 is illustrated at a particular longitudinal location with respect to the longitudinal axis 30, additional flow controlled ports 54 may be provided at different radial locations at the same longitudinal location, and such additional flow-controlled ports 54 may be fluidically connected to separate secondary conduits 48, or may alternately be connected to a manifold (not shown) which directs slurry into the secondary conduit 48. In one embodiment, the secondary conduit 48 is arranged on the exterior surface 32 of the tubular 18 and may extend from the flow controlled port 54 in a direction substantially parallel to the longitudinal axis 30. A second end 56, such as an uphole end, of the secondary conduit 48 is longitudinally spaced from the first end 52 of the secondary conduit 48, and the length of each secondary conduit 48 is at least long enough to bypass a zone or plurality of adjacent zones. The second end 56 of the secondary conduit 48 is fluidically connected to a distributor manifold 58. The distributor manifold 58 receives the cement slurry 22 delivered from the tubular 18, through the flow-controlled port 54, and through the secondary conduit 48. The distributor manifold 58 includes one or more exit openings 60, such as a plurality of radially distributed exit openings 60, to distribute the cement slurry 22 radially around the exterior of the tubular 18 within the annulus 26 to fill a particular zone. The openings 60 may be positioned on the distributor manifold 58 to allow cement slurry 22 to flow on all sides of the tubular 18 ensuring better cement coverage.

Downhole of each distributor manifold 58 is a settable packer 28. The secondary conduit 48 passes the packer 28 to access the distributor manifold 58. The packer 28 is activatable to fill and at least substantially seal the annulus 26 at a particular longitudinal location. In one embodiment, the packer 28 is electrically activatable, however the packer 28 may alternatively be hydraulically, chemically, or mechanically activatable. The packer 28 may also include more than one setting mechanism or more than one type of setting mechanism for redundancy. The packer 28 is utilized to isolate distinct zones and help reduce additional hydrostatic acting on weaker zones.

For illustrative purposes, the zone isolation cementing system 10 is disposed in a formation having first, second, and third zones 62, 64, 66. The first, second, and third zones 62, 64, 66 may be pre-determined to have different formation qualities that would benefit from separate cementing processes. The zone isolation cementing system 10 is therefore illustrated as having first and second secondary conduits 68, 70, amongst a plurality of the conduits 48, connected at longitudinally spaced first and second flow-controlled ports 72, 74, amongst a plurality of the flow-controlled ports 54. The illustrated zone isolation cementing system 10 further includes first and second distributor manifolds 76, 78, amongst a plurality of the distributor manifolds 58, longitudinally spaced from each other within different zones. In particular, first distributor manifold 76 is located in the second zone 64, and the second distributor manifold 78 is located in the third zone 66. The illustrated zone isolation cementing system 10 further includes first and second settable packers 80, 82, amongst a plurality of the settable packers 28, to separate the first, second, and third zones 62, 64, 66 from each other. In particular, the first settable packer 80 may be activated to separate the first zone 62 from the second zone 64, and the second settable packer 82 may be activated to separate the second zone 64 from the third zone 66. For example a first depleted area 84 may be a weakened area in the formation 16 and therefore the column of cement in the first zone 62 may not be properly supported uphole of the first depleted area 84 if the cement sheath extends beyond the first depleted area 84. Thus, the first settable packer 80 is set just uphole of the first depleted area 84 to separate the first zone 62 from the second zone 64. Likewise, the second settable packer 82 is settable uphole of a second depleted area 86 to separate the third zone 66 from the second zone 64.

While a three zone system is illustrated and described for illustrative purposes, it should be understood that any number of zones may be separated using the zone isolation system 10, by adding an appropriate number of secondary conduits 48, settable packers 28, and distributor manifolds 58 to the zone isolation cementing system 10. In one embodiment, the zone isolation cementing system 10 may be a modular system in which an appropriate number of distributor manifolds 58 and packers 28 may be selectively longitudinally disposed along the exterior surface 32 of the tubular 18 as needed to divide the annulus 26 into the selected number of zones. Secondary conduits 48 having the necessary lengths to span the one or more zones may then be selected to connect between the flow-controlled ports 54 and the distributor manifolds 58. The tubular 18 may be manufactured to include a number of longitudinally displaced flow-controlled ports 54, and a subset of these ports 54 may be blocked if not required for a particular operation. Alternatively, a selection of tubulars 18 may be manufactured having differing numbers of flow-controlled ports 54.

Figure 3:
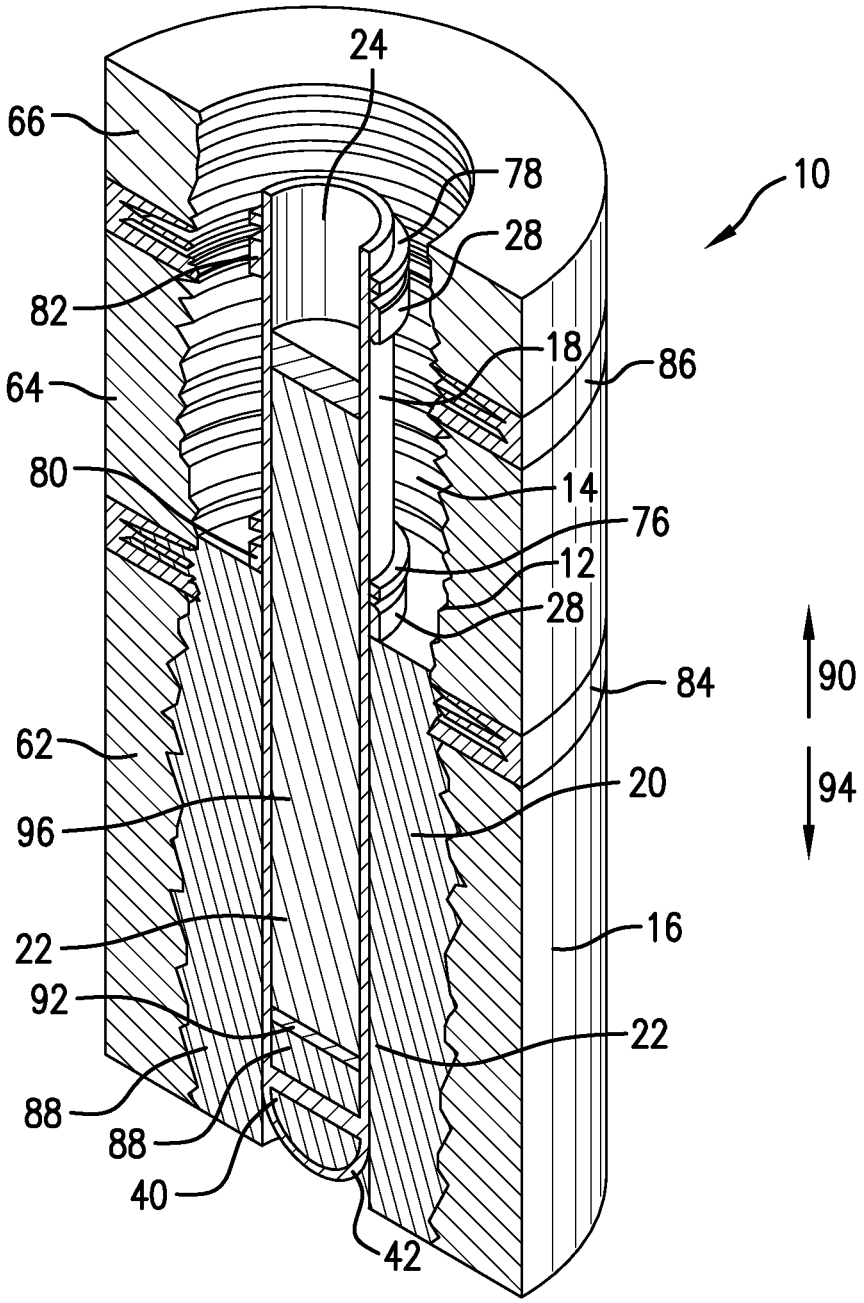
FIG. 3 depicts a perspective cut-away view of the zone isolation cementing system with cement slurry disposed in a first zone of the borehole.

With reference now to FIGS. 3-7, a method of utilizing the zone isolation cementing system 10 within the borehole 14 for a multi-zone cementing operation is shown. FIG. 3 illustrates a first stage 88 of cement slurry 22 that has substantially exited the float equipment 40 to the annulus 26 within the first zone 62. After the first stage 88 of cement slurry 22 has exited the float equipment 40 it may fill the first zone 62 by moving in the uphole direction 90. An illustrative small amount of the first stage 88 of cement slurry 22 is depicted in flowbore 24 of the tubular 18, but will be pushed out by a first plug 92, such as a cement-wiper plug, that moves in the downhole direction 94 towards the float equipment 40. Following the first plug 92 is a second stage 96 of cement slurry 22 pumped behind the first plug 92, and the first plug 92 will be displaced by the second stage 96 of cement slurry 22. The volume of the first stage 88 of cement slurry 22 may be such that it will cover as much of the annulus 26 as feasible without anticipated losses.

Figure 4:
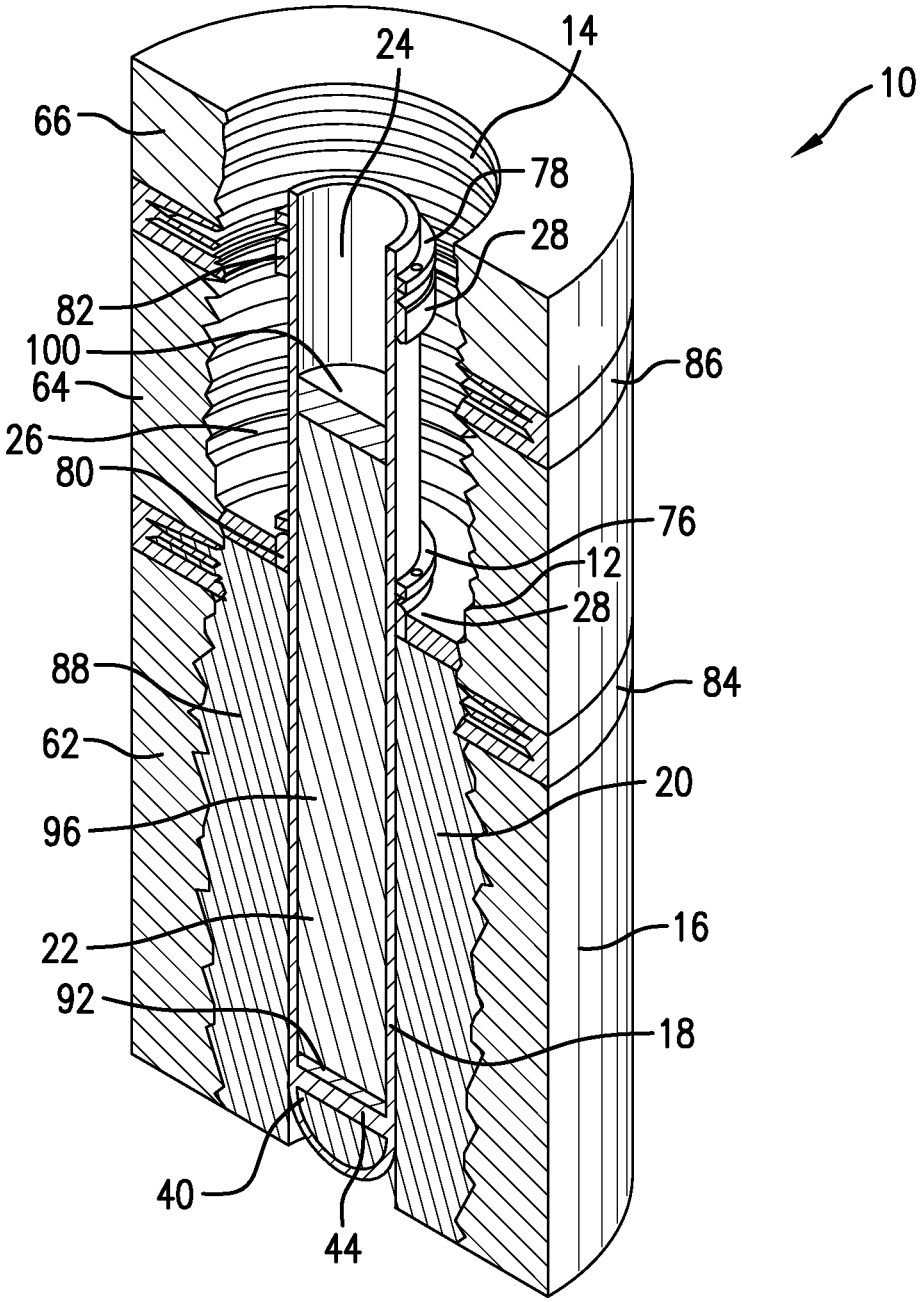
FIG. 4 depicts a perspective cut-away view of the zone isolation cementing system with a first packer expanded.

With reference to FIG. 4, the remainder of the first stage 88 of cement slurry 22 is pushed into the annulus 26 by the first plug 92, and the first plug 92 may be seated on the float collar 44 of the float equipment 40, thus blocking an opening 98 in the float equipment 40 (shown in FIGS. 1 and 2) such that the second stage 96 of cement slurry 22 cannot escape through the exit opening 46 of the float equipment 40. The first plug 92 does not block the first port 72. The first settable packer 80 is set as shown in FIG. 4, using at least one setting mechanism for setting the packer 80. The first settable packer 80 separates the first zone 62 from all zones uphole of the first settable packer 80. Because the first plug 92 blocks the float equipment 40, the only exit for the second stage 96 of cement slurry 22 will be through the first flow-controlled port 72 and into the first secondary conduit 68 (shown in FIGS. 1 and 2). The second flow-controlled port 74, as well as any additional flow-controlled ports 54 other than the first flow-controlled port 72, will remain closed. The first flow-controlled port 72 may include a valve that is electrically or hydraulically controlled. Alternatively, the port 72 may include a dissolvable or disintegratable material within the port 72 that reacts to a chemical in the second stage 96 of cement slurry 22, whereas the remainder of flow-controlled ports 54 not connected to a first secondary conduit 68 do not react to the chemical in the second stage 96 of cement slurry 22 so that only the first flow-controlled port 72 opens in response to the second stage 96 of cement slurry 22. Due to the first distributor manifold 76 disposed uphole of the first settable packer 80, the second stage 96 of cement slurry 22 will be redirected to the second zone 64 uphole the first settable packer 80 by the first secondary conduit 68. A second plug 100, such as a cement wiper-plug, follows the second stage 96 of cement slurry 22.

Figure 5:
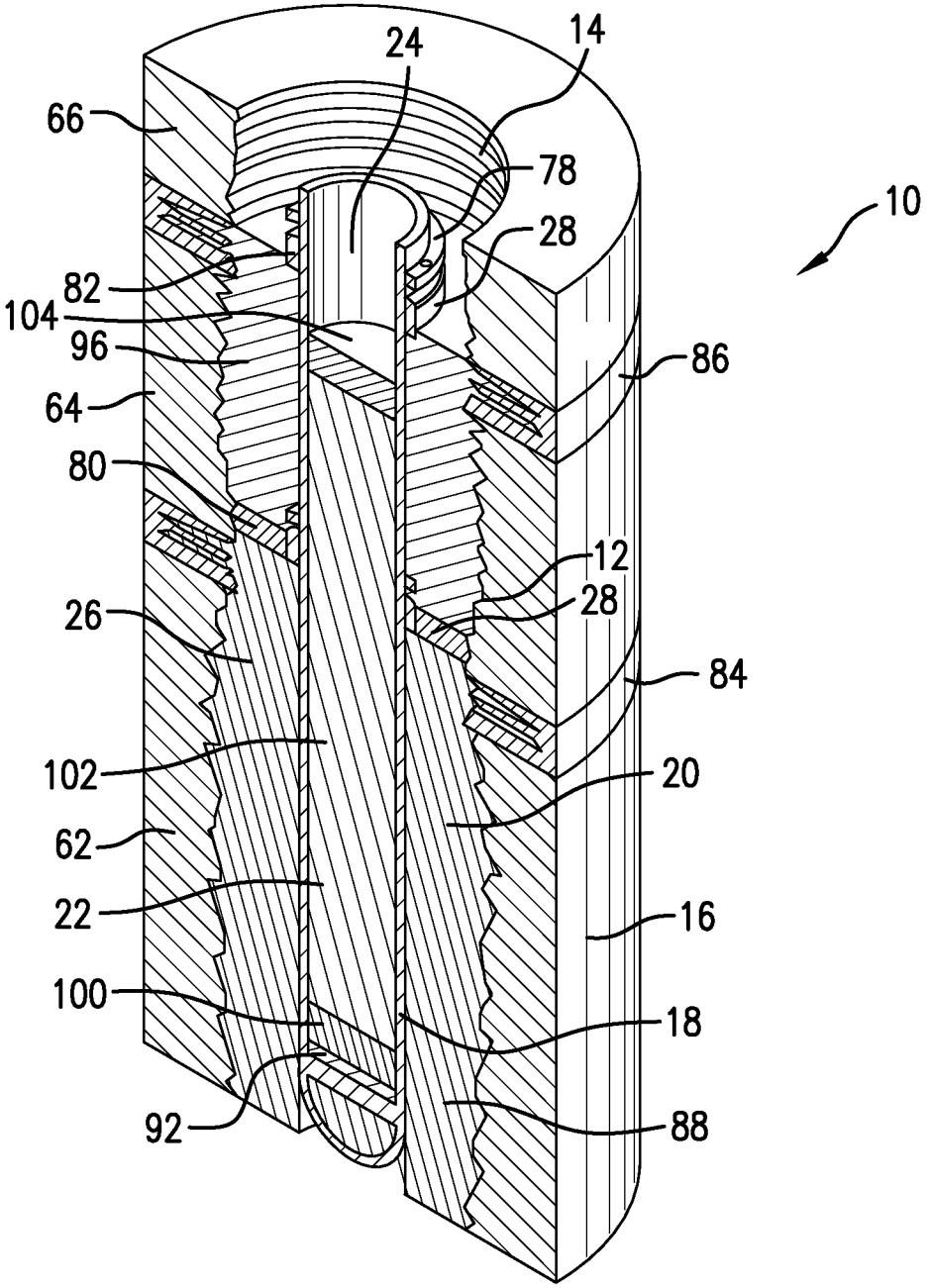
FIG. 5 depicts a perspective cut-away view of the zone isolation cementing system with cement slurry disposed in a second zone of the borehole.
Figure 6:
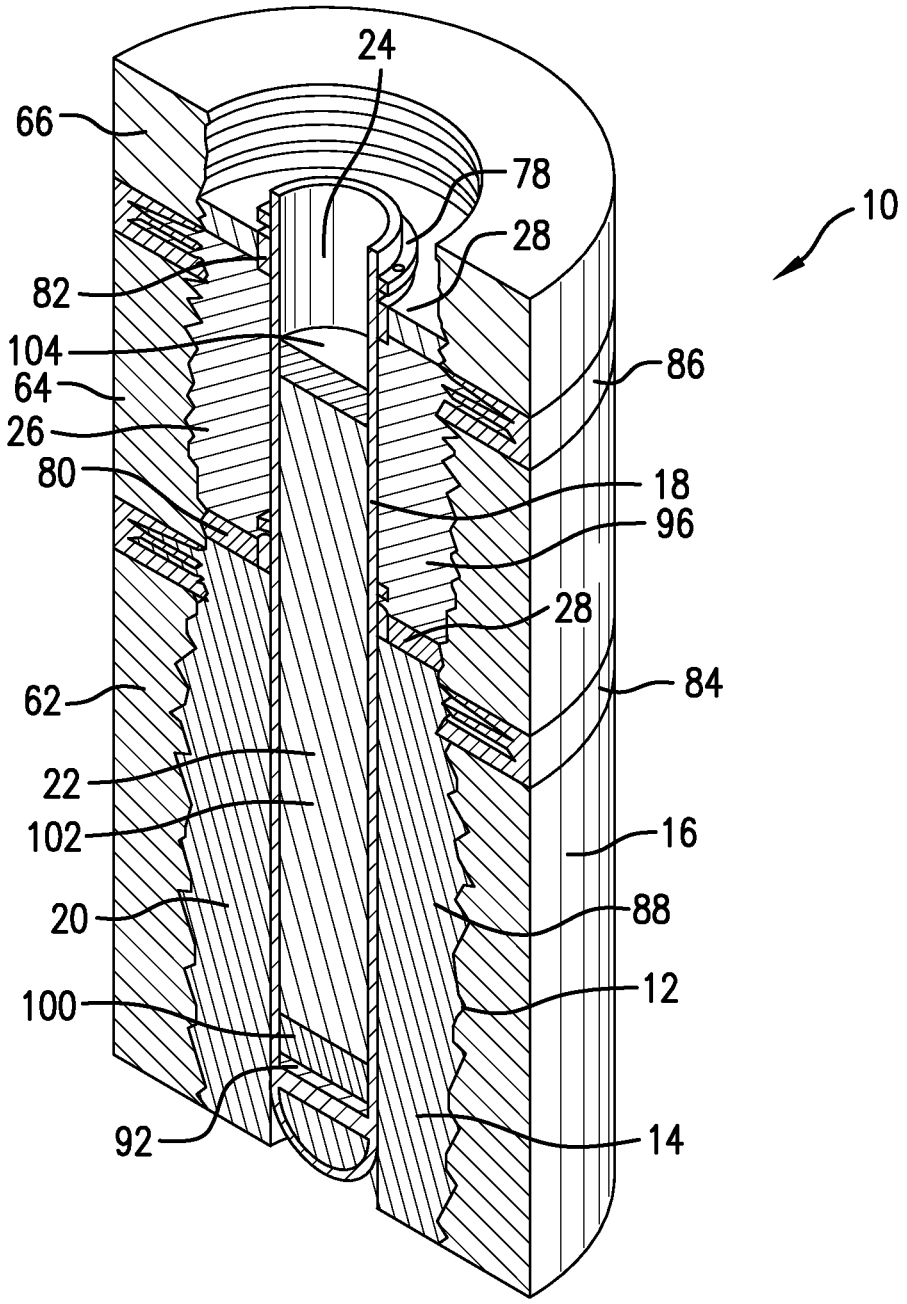
FIG. 6 depicts a perspective cut-away view of the zone isolation cementing system with a second packer expanded; and, FIG. 7 depicts a perspective cut-away view of the zone isolation cementing system with cement slurry disposed in a third zone.
Figure 7:
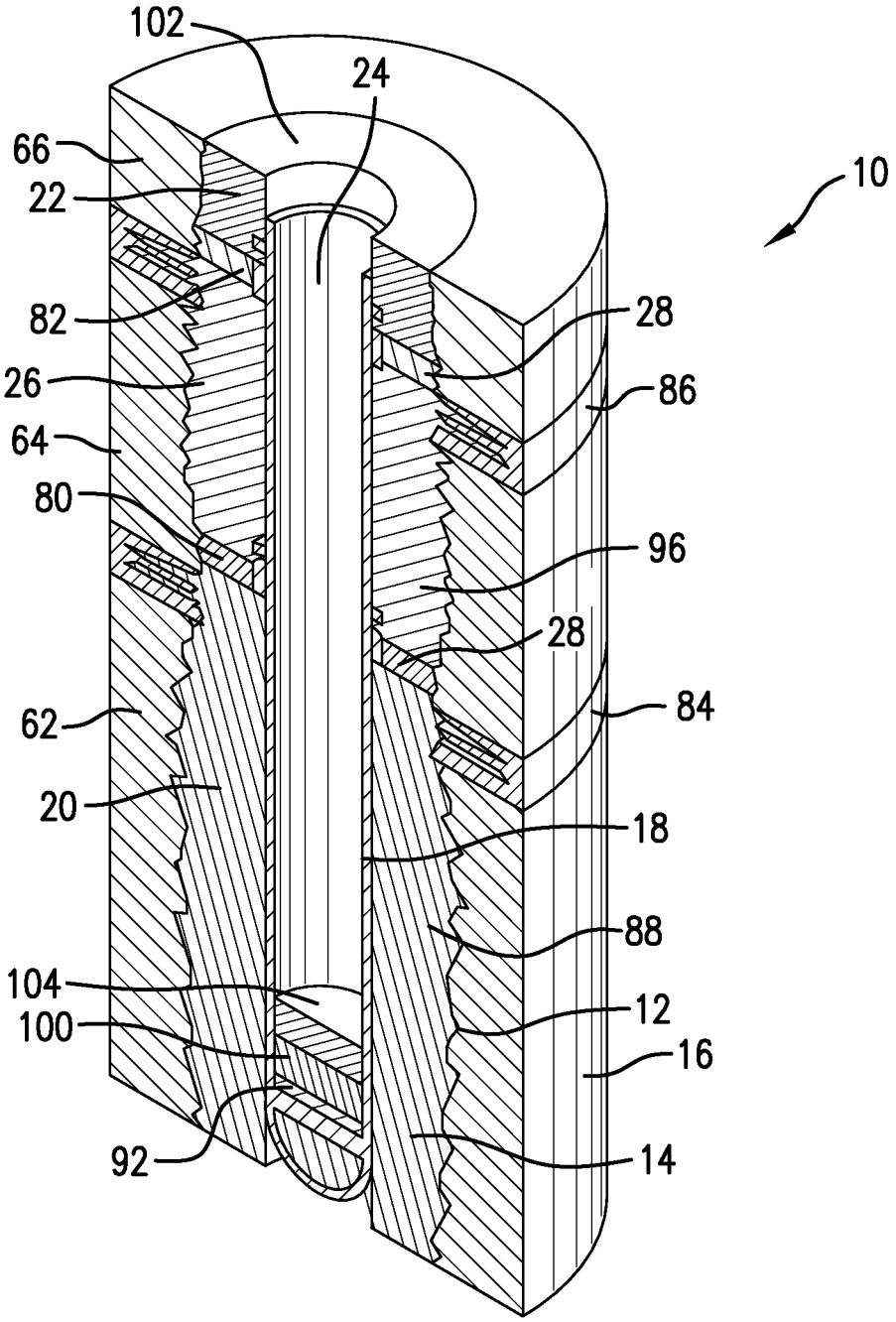

Turning now to FIG. 5, the second stage 96 of cement slurry 22 is shown depicted in the second zone 64 and the second plug 100 may land on the first plug 92 or on a shoulder within the tubular 18. The second plug 100 blocks a third stage 102 of cement slurry 22 disposed uphole of the second plug 100 from accessing the first flow-controlled port 72. The first flow-controlled port 72 may be physically blocked by the second plug 100, or the second plug 100 may be stopped just uphole of the first flow-controlled port 72 for blocking access thereto. With reference to FIG. 6, the second settable packer 82 is set to at least substantially separate the second zone 64 from any zones (including the third zone 66) uphole of the second settable packer 82. A second flow-controlled port 74 is opened and, as shown in FIG. 7, the second stage 102 of cement slurry 22 is forced into the third zone 66 through the second flow-controlled port 74 and the second secondary conduit 70. A third plug 104, such as a cement-wiper plug, may follow the third stage 102 of cement slurry 22 and land on or uphole of the second plug 100 after the cement slurry 22 from the third stage 102 moves into the second zone 64. The third plug 104 may block fluidic access to the second flow-controlled port 74. After passage of the third stage 102 of cement slurry 22 into the annulus 26, the tubular 18 is depicted as substantially open and thus production equipment or other downhole tools may be disposed within the tubular 18. Alternatively, additional stages of cement slurry 22 may be passed through the tubular 18 and into additional zones as previously described.

Thus, embodiments of systems and methods have been described to deliver multiple barriers, both cement slurry 22 and settable packers 28, activated by different mechanisms, that rely on different isolation philosophies thus providing the best in class isolation techniques for a particular job. Further, it should be understood that the borehole 14 may extend in any direction, including vertically, horizontally, and at various angles from a surface. Thus, the system 10 is also useful, in one embodiment, for supporting a tubular 18 within long horizontal wells with weak sections. The settable packers 28 retain the cement slurry 22 into selected zones. The presence of the secondary conduits 48 will allow cement slurry 22 to be redirected to difficult to access portions of the horizontal borehole. A first step may be to circulate the borehole 14 to clean out gelled mud prior to pumping cement slurry 22, and just before the cement slurry 22 reaches the float shoe 42, the settable packers 28 may be activated. The slurry 22 will then be pumped out and redirected to the required zone by the secondary conduits 48.

Set forth below are some embodiments of the foregoing disclosure:

Embodiment 1

A zone isolation cementing system including: a tubular having a longitudinal axis and a first flow-controlled port; a first conduit having a first end and a second end, the first end fluidically connected to the first flow-controlled port; a first distributor manifold arranged to deliver cement slurry exteriorly of the tubular, the second end of the first conduit fluidically connected to the first distributor manifold; and, a first settable packer disposed exteriorly of the tubular and arranged longitudinally between the first flow-controlled port and the first distributor manifold.

Embodiment 2

The zone isolation cementing system of embodiment 1, further comprising float equipment disposed at a downhole end of the tubular.

Embodiment 3

The zone isolation cementing system of embodiment 2, further comprising first and second plugs movable within the tubular, the first plug arranged to push a first stage of cement slurry through the float equipment and into an annulus exterior to the tubular, and the second plug arranged to push a second stage of cement slurry through the first flow-controlled port, first conduit, and first distributor manifold.

Embodiment 4

The zone isolation cementing system of Embodiment 3, wherein the first plug is configured to block entry to the float equipment.

Embodiment 5

The zone isolation cementing system of Embodiment 1, wherein the tubular further includes a second flow-controlled port longitudinally displaced from the first flow-controlled port, and the system further includes: second conduit having a first end and a second end, the first end of the second conduit fluidically connected to the second flow-controlled port; a second distributor manifold, the second end of the second conduit fluidically connected to the second distributor manifold; and, a second settable packer disposed exteriorly of the tubular and arranged longitudinally between the second flow-controlled port and the second distributor manifold.

Embodiment 6

The zone isolation cementing system of embodiment 5, wherein the second settable packer is disposed between the first distributor manifold and the second distributor manifold.

Embodiment 7

The zone isolation cementing system of embodiment 5, further comprising first and second plugs movable within the tubular, the first plug arranged to push a first stage of cement slurry through float equipment and into an annulus exterior to the tubular, and the second plug arranged to push a second stage of cement slurry through the first flow-controlled port, first conduit, and first distributor manifold.

Embodiment 8

The zone isolation system of embodiment 7, further comprising a third plug movable within the tubular, the third plug arranged to push a third stage of cement slurry through the second flow-controlled port, second conduit, and second distributor manifold.

Embodiment 9

The zone isolation cementing system of embodiment 1, wherein the first distributor manifold is ring-shaped and radially surrounds an exterior surface of the tubular.

Embodiment 10

The zone isolation cementing system of embodiment 1, wherein the first distributor manifold includes a plurality of radially distributed exit openings.

Embodiment 11

The zone isolation cementing system of embodiment 1, wherein the first conduit and the first distributor manifold are disposed exteriorly of the tubular.

Embodiment 12

A method of isolating zones during a cementing operation, the method comprising: delivering a first stage of cement slurry through a tubular and into a first zone of a borehole annulus; setting a first packer; and, moving a second stage of cement slurry through a first flow-controlled port in the tubular, through a first conduit, into a first distributor manifold, and delivering the second stage of cement slurry into a second zone, wherein the second zone is separated from the first zone by the first packer.

Embodiment 13

The method of embodiment 12, wherein delivering a first stage of cement slurry into a first zone includes passing the first stage of cement slurry through float equipment, and further comprising blocking an entrance to the float equipment using a first plug following the first stage of cement slurry.

Embodiment 14

The method of embodiment 12, further comprising following the first stage of cement slurry with a first plug, and blocking entry into the first zone using the first plug.

Embodiment 15

The method of embodiment 14, further comprising following the second stage of cement slurry with a second plug, and blocking access to the first flow-controlled port with the second plug.

Embodiment 16

The method of embodiment 15, further comprising setting a second packer, and moving a third stage of cement slurry out a second flow-controlled port in the tubular, through a second conduit, into a second distributor manifold, and delivering the third stage of cement slurry into a third zone, wherein the third zone is separated from the second zone by the second packer.

Embodiment 17

The method of embodiment 12, wherein delivering the second stage of cement slurry into the second zone includes bypassing the first zone with the first conduit.

Embodiment 18

The method of embodiment 12, further comprising, prior to delivering the first stage of cement slurry through the tubular, locating a weakened area surrounded the borehole, and running the tubular within the borehole to align the first annular packer uphole of the weakened area.

Embodiment 19

The method of embodiment 12, wherein the first distributor manifold includes a plurality of radially distributed exit openings to radially distribute the second stage of cement slurry substantially uniformly within the second zone.

Embodiment 20

A method of isolating zones during a cementing operation, the method comprising: disposing the zone isolation cementing system of claim 1 within a borehole; delivering a first stage of cement slurry through the tubular and into a first zone; setting the first packer, and, delivering a second stage of cement slurry out the first flow-controlled port in the tubular, through the first conduit, into the first distributor manifold, and into a second zone, wherein the second zone is separated from the first zone by the first annular packer.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A zone isolation cementing system including:

a tubular having a longitudinal axis, an interior flowbore, and a first flow-controlled port, an annulus defined between the tubular and a borehole, the first flow-controlled port disposed within a first zone of the annulus;

a first conduit positioned radially exteriorly of the interior flowbore, the first conduit having a first end and a second end, the first end fluidically connected to the first flow-controlled port;

a first distributor manifold in a second zone of the annulus and arranged to deliver cement slurry exteriorly of the tubular, the second end of the first conduit fluidically connected to the first distributor manifold; and, a first settable packer disposed exteriorly of the tubular and arranged longitudinally between the first flow-controlled port and the first distributor manifold, the first settable packer activatable to at least substantially seal the annulus and separate the first zone from the second zone;

wherein the first conduit extends from the first flow-controlled port, passes the first settable packer, and extends to the first distributor manifold, and the first conduit enables cement slurry exiting the tubular through the first flow-controlled port to bypass the first zone and be redirected to the second zone.

2. The zone isolation cementing system of claim 1, further comprising float equipment disposed at a downhole end of the tubular.

3. The zone isolation cementing system of claim 1, wherein the tubular further includes a second flow-controlled port longitudinally displaced from the first flow-controlled port, and the system further includes:

a second conduit having a first end and a second end, the first end of the second conduit fluidically connected to the second flow-controlled port;

a second distributor manifold, the second end of the second conduit fluidically connected to the second distributor manifold; and, a second settable packer disposed exteriorly of the tubular and arranged longitudinally between the second flow-controlled port and the second distributor manifold.

4. The zone isolation cementing system of claim 3, wherein the second settable packer is disposed between the first distributor manifold and the second distributor manifold.

5. The zone isolation cementing system of claim 3, further comprising first and second plugs movable within the tubular, the first plug arranged to push a first stage of cement slurry through float equipment and into the first zone of the annulus, and the second plug arranged to push a second stage of cement slurry through the first flow-controlled port, first conduit, first distributor manifold, and into the second zone of the annulus.

6. The zone isolation system of claim 5, further comprising a third plug movable within the tubular, the third plug arranged to push a third stage of cement slurry through the second flow-controlled port, second conduit, second distributor manifold, and into a third zone of the annulus, the third zone and the second zone separated by the second settable packer.

7. The zone isolation cementing system of claim 1, wherein the first distributor manifold is ring-shaped and radially surrounds an exterior surface of the tubular.

8. The zone isolation cementing system of claim 1, wherein the first distributor manifold includes a plurality of radially distributed exit openings.

9. The zone isolation cementing system of claim 1, wherein the first conduit and the first distributor manifold are disposed exteriorly of the tubular and within the annulus.

10. A method of isolating zones during a cementing operation, the method comprising:

disposing the zone isolation cementing system of claim 1 within the borehole;

delivering a first stage of cement slurry through the tubular and into the first zone;

setting the first packer; and, delivering a second stage of cement slurry out the first flow-controlled port in the tubular, through the first conduit, into the first distributor manifold, and into the second zone.

11. A zone isolation cementing system including:

a tubular having a longitudinal axis and a first flow-controlled port;

a first conduit having a first end and a second end, the first end fluidically connected to the first flow-controlled port;

a first distributor manifold arranged to deliver cement slurry exteriorly of the tubular, the second end of the first conduit fluidically connected to the first distributor manifold; and, a first settable packer disposed exteriorly of the tubular and arranged longitudinally between the first flow-controlled port and the first distributor manifold;

float equipment disposed at a downhole end of the tubular; and, first and second plugs movable within the tubular, the first plug arranged to push a first stage of cement slurry through the float equipment and into an annulus, and the second plug arranged to push a second stage of cement slurry through the first flow-controlled port, first conduit, and first distributor manifold.

12. The zone isolation cementing system of claim 11, wherein the first plug is configured to block entry to the float equipment.

13. A method of isolating zones during a cementing operation, the method comprising:

delivering a first stage of cement slurry through a tubular and into a first zone of a borehole annulus;

setting a first packer; and, after setting the first packer and delivering the first stage of cement slurry into the first zone, moving a second stage of cement slurry through a first flow-controlled port in the tubular, through a first conduit, into a first distributor manifold, and delivering the second stage of cement slurry into a second zone, wherein the second zone is separated from the first zone by the first packer, the first flow-controlled port is disposed in the first zone, the first distributor manifold is disposed in the second zone, and the first conduit connects the first flow-controlled port to the first distributor manifold.

14. The method of claim 13, wherein delivering a first stage of cement slurry into a first zone includes passing the first stage of cement slurry through float equipment, and further comprising blocking an entrance to the float equipment using a first plug following the first stage of cement slurry.

15. The method of claim 13, further comprising following the first stage of cement slurry with a first plug, and blocking entry into the first zone using the first plug.

16. The method of claim 15, further comprising following the second stage of cement slurry with a second plug, and blocking access to the first flow-controlled port with the second plug.

17. The method of claim 16, further comprising setting a second packer, and moving a third stage of cement slurry out a second flow-controlled port in the tubular, through a second conduit, into a second distributor manifold, and delivering the third stage of cement slurry into a third zone, wherein the third zone is separated from the second zone by the second packer.

18. The method of claim 13, wherein delivering the second stage of cement slurry into the second zone includes bypassing the first zone with the first conduit.

19. The method of claim 13, further comprising, prior to delivering the first stage of cement slurry through the tubular, locating a weakened area surrounded the borehole, and running the tubular within the borehole to align the first annular packer uphole of the weakened area.

20. The method of claim 13, wherein the first distributor manifold includes a plurality of radially distributed exit openings to radially distribute the second stage of cement slurry substantially uniformly within the second zone.

* * * * *